US005255836A

United States Patent [19]

Herber et al.

[11] Patent Number: 5,255,836

[45] Date of Patent: Oct. 26, 1993

[54] FLAME SPRAY GUN WITH WIRE FEED CONTROL

[75] Inventors: Ralph H. Herber, Mainz; Karsten J. Eichhorn, Frankfurt am Main, both of Fed. Rep. of Germany

[73] Assignee: The Perkin-Elmer Corporation, Norwalk, Conn.

[21] Appl. No.: 8,258

[22] Filed: Jan. 25, 1993

Related U.S. Application Data

[63] Continuation of Ser. No. 466,368, Oct. 9, 1990, abandoned.

[30] Foreign Application Priority Data

Jul. 27, 1988 [DE] Fed. Rep. of Germany ..... 3825510

[51] Int. Cl.[5] ..... B65H 23/16

[52] U.S. Cl. ..... 226/24

[58] Field of Search ..... 226/2, 10, 24, 27, 34, 226/35, 45, 176, 187; 242/75.2, 75.3

[56] References Cited

U.S. PATENT DOCUMENTS

| | | | |
|---|---|---|---|
| 2,769,663 | 11/1956 | Jensen et al. | 299/28.8 |
| 3,024,956 | 3/1962 | Gretter | 226/34 |
| 3,148,818 | 9/1964 | Charlop | 226/176 |
| 3,330,458 | 7/1967 | Bentzman | 226/187 X |
| 3,632,031 | 1/1972 | Gurner | 226/187 |
| 3,833,162 | 9/1974 | Sato | 226/187 X |
| 3,870,214 | 3/1975 | Schmid | 226/34 |
| 3,906,184 | 9/1975 | Gibbs et al. | 219/131 F |
| 4,025,003 | 5/1977 | Fleck et al. | 226/176 X |
| 4,033,496 | 7/1977 | Rolfe | 226/187 X |
| 4,158,429 | 6/1979 | Ohmai | 226/191 X |
| 4,720,044 | 1/1988 | Stemwedel, Jr. | 239/89 |
| 5,074,469 | 12/1991 | Herber | 226/187 X |

FOREIGN PATENT DOCUMENTS

| | | |
|---|---|---|
| 0142915 | 5/1985 | European Pat. Off. . |
| 2069373A | 8/1981 | United Kingdom . |

*Primary Examiner*—Daniel P. Stodola
*Assistant Examiner*—Paul T. Bowen
*Attorney, Agent, or Firm*—H. S. Ingham; E. T. Grimes; J. R. Wahl

[57] ABSTRACT

A wire flame spray apparatus includes a wire feed pulley driven by a motor. A first counterpulley urges a wire into engagement with the feed pulley. A detector pulley with a second counterpulley engages the wire to detect actual wire feed rate. A balance beam supports the counterpulleys. A pressure cylinder acts on the beam to increase counterpulley force on the wire in response to a lagging of actual feed rate from a predetermined feed rate so as to avert slippage of the wire on the feed pulley. A sensor senses changes in rotational speed of the detector pulley and generates signals to increase the counterpulley force. A microprocessor provides control signals for the motor and pressure cylinder.

12 Claims, 4 Drawing Sheets

FLAME SPRAY GUN WITH WIRE FEED CONTROL

Figure 1:
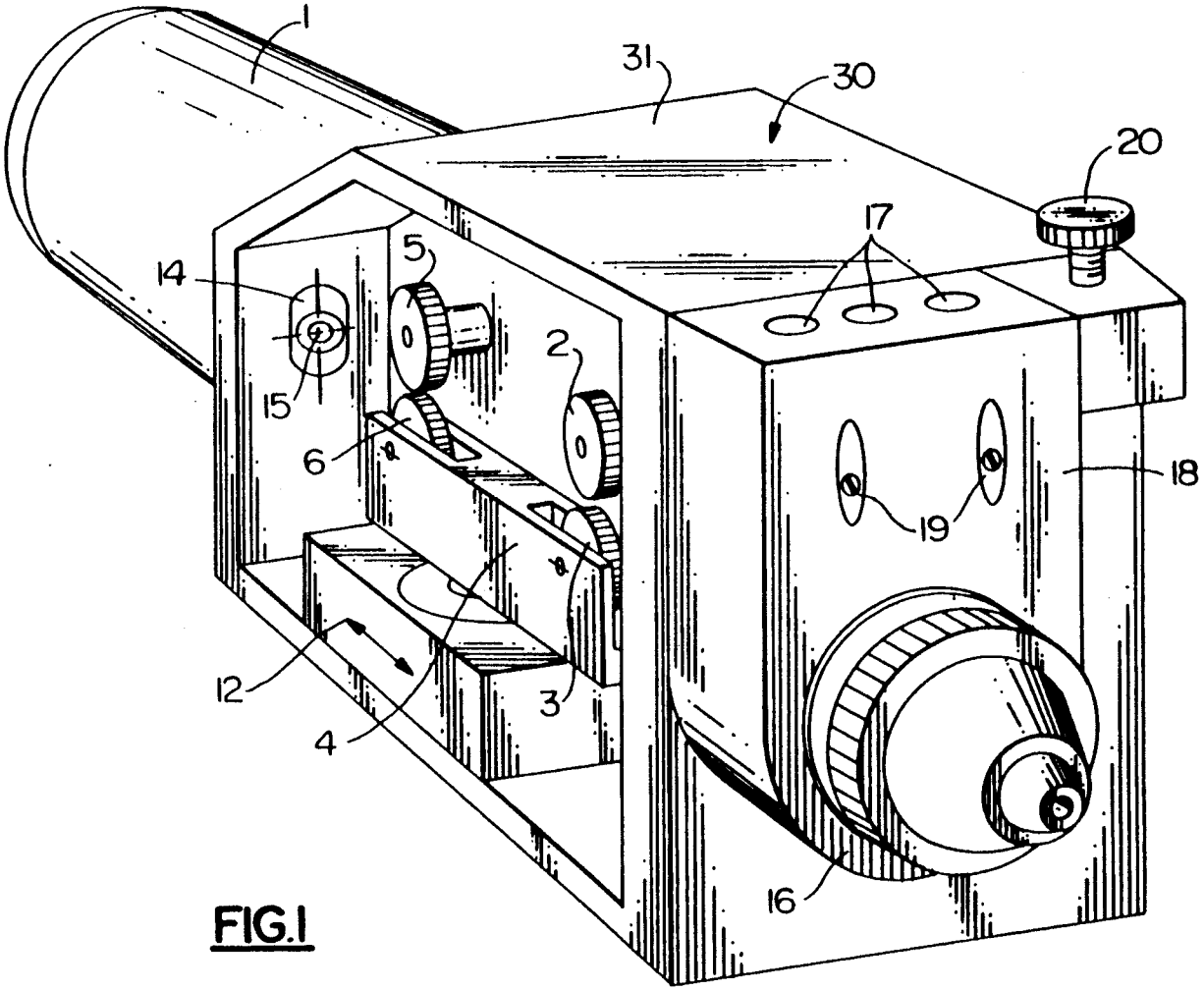

This is a continuation of co-pending application Ser. No. 466,368 filed on Oct. 9, 1990, now abandoned.

DESCRIPTION

The invention relates to a wire gun comprising a wire feed mechanism including a wire feed pulley driven by a motor and a counterpulley biasing the wire into engagement with the wire feed pullley, and means for controlling the wire feed rate.

Wire guns (also known as "wire pistols") of this type are employed in so-called flame-spraying operations, the feed mechanism being operated to feed the wire to a gas burner head provided with a spray nozzle. The combustion of a gas supplied to the gas burner head together with compressed air and oxygen causes the wire material to melt, the thus molten material being subsequently expelled through the nozzle together with the combusted gas.

It is of considerable importance to maintain the wire feed rate as constant as possible to thereby ensure a uniform supply of the wire material to be sprayed.

In known wire pistols of the type indicated above, it is attempted to maintain the wire feed rate as constant as possible by controlling the rotational speed of the feed motor so as to keep it substantially constant. It has been found, however, that this method is unsuitable for obtaining a sufficiently constant wire feed rate and thus a uniform supply of the wire material to be sprayed.

It is an object of the invention to provide a wire pistol capable of ensuring a constant wire feed rate and thus a uniform supply of the wire material to be sprayed in a flame-spraying operation.

This object is attained according to the invention by the provision that there is provided a detector pulley engaging the wire for detecting the actual value of the wire feed rate, and that said means for controlling the wire feed rate includes a mechanism for varying the biasing force of the counterpulley in response to a deviation of said actual value from the rated value incapable of being compensated by the action of the speed control means on the motor-driven feed mechanism.

This solution according to the invention is effective to ensure that the wire is advanced at a constant feed rate by permitting any slippage occurring between the feed pulley and the wire and resulting in a non-uniform wire feed to be detected by measuring the actual value of the feed rate and to be eliminated by increasing the biasing force exerted by the counterpulley on the wire.

An advantageous modification of the invention consists in the provision of a counterpulley acting to bias the wire into engagement with the detector pulley. This counterpulley may advantageously mounted together with the counterpulley of the feed pulley on a balance beam subjected to the action of a biasing device acting to bias the counterpulleys towards the feed pulley and the detector pulley, respectively.

The balance beam may be connected to a wall of the housing provided for the wire pistol by a hinged link and thus be secured in position.

A particular advantage results when the biasing device is adjustable along the balance beam, i.e. when the point of attack of the biasing force is displaceable. In this case the biasing force of the biasing device, which may suitably be designed as a pressure cylinder, may be unevenly distributed between the counterpulley for the detector pulley and the counterpulley for the feed pulley, to thereby vary the force exerted by the counterpulley for biasing the wire into engagement with the feed pulley for thus adjusting the slippage between the wire and the feed pulley.

The detector pulley for detecting the actual value of the wire feed rate may advantageously be connected to an incremental rotation sensor operable to generate a digital signal indicative of the feed rate.

This signal may be further processed, together with a measured value indicative of the rotational speed of the feed motor, which may be supplied by a tachometer to be connected to the feed motor, by a microprocessor system advantageously provided for the generation of control signals.

The microprocessor system generates control signals acting on a control circuit to be provided for supplying the feed motor with an operating voltage, and on a control device to be provided for varying the biasing force of the counterpulley, particularly for varying the pressure in a pressure cylinder.

Further advantageous embodiments and modifications of the invention are apparent from the subclaims.

Figure 2:
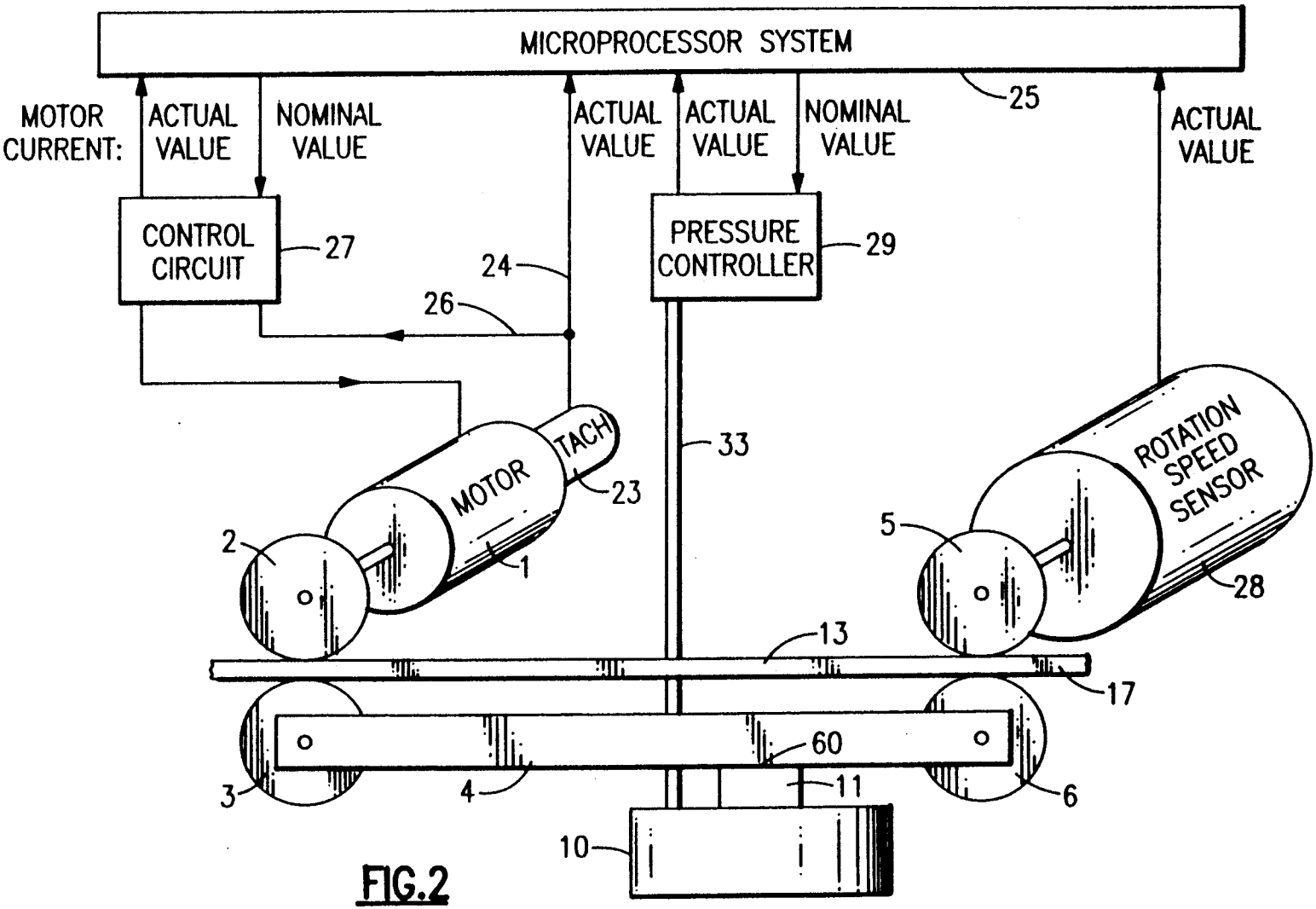
Figure 3:
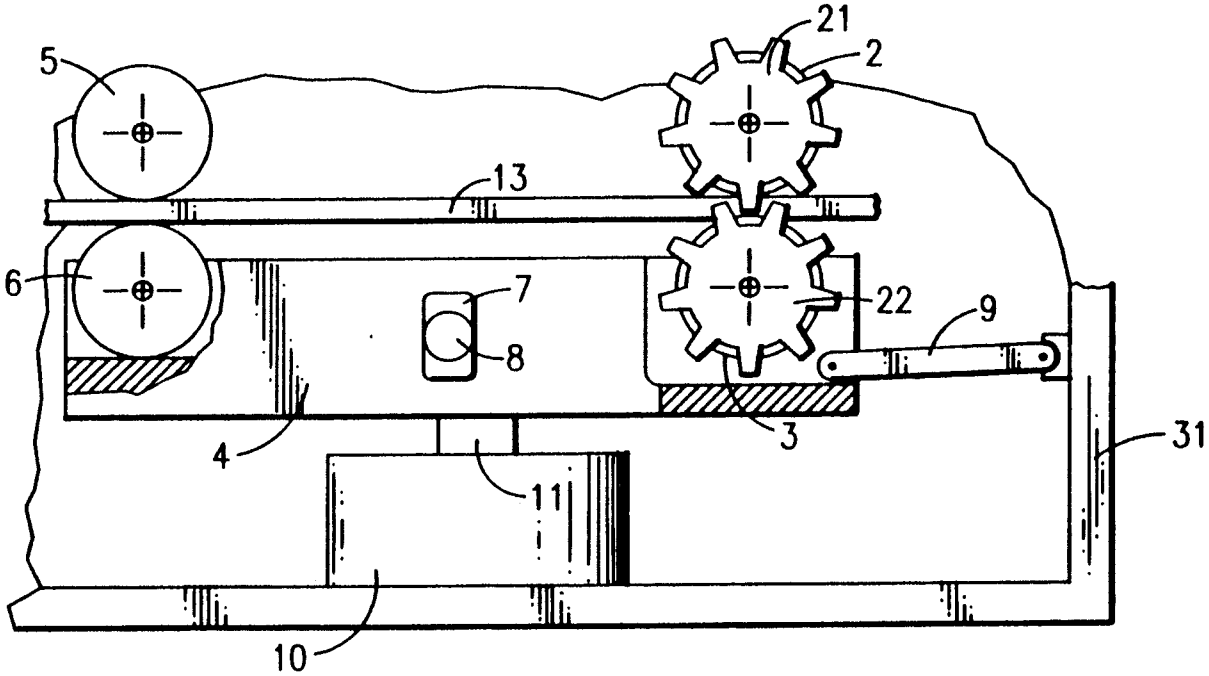
Figure 4:
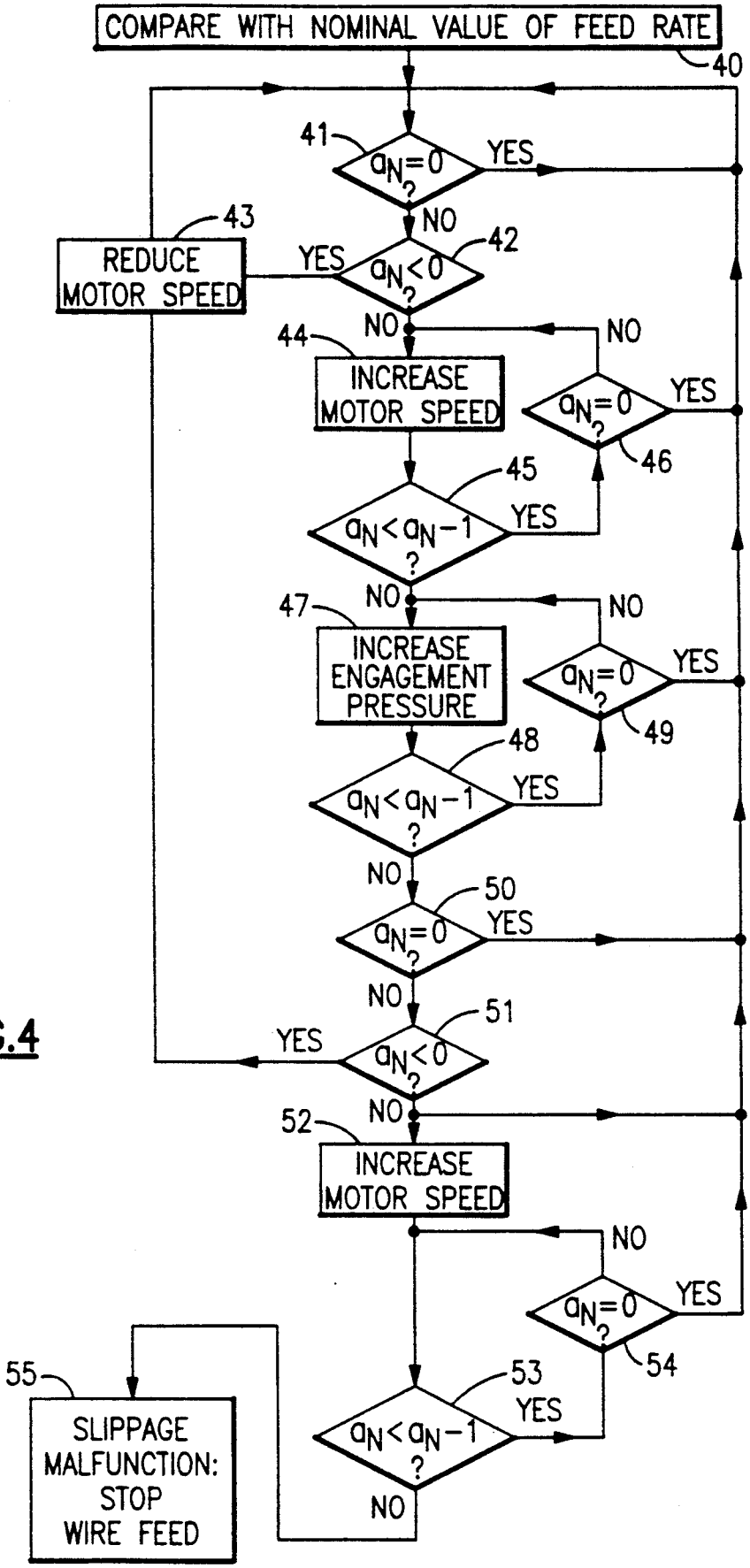

Embodiments of the invention shall now be explained and described by way of example with reference to the accompanying drawings, wherein:

FIG. 1 shows an embodiment of a wire gun according to the invention, including a gas burner head for a flame-spraying operation, a housing wall and transmission gears having been omitted in this figure for better understanding, FIG. 2 shows a diagrammatic illustration of the wire feed control operation with the elimination of slippage, FIG. 3 shows a diagrammatic illustration of parts of the wise feed mechanism including an additionally driven counterpulley, and FIG. 4 shows a flow chart of the wire feed rate control operation.

A wire gun (also designated herein as "pistol") is generally indicated at 30 in FIG. 1. Secured to a housing 31 is a feed motor 1 operable to rotate a feed pulley 2 about a stationary axis. The wire (not shown) to be fed passes between feed pulley 2 and a first counterpulley 3 capable of being forced with a biasing force into engagement with feed pulley 2 and having for this purpose its axis adjustably mounted in a balance beam 4. Disposed upstream of feed pulley 2 in the wire feed direction is a detector pulley 5 mounted for rotation about a likewise stationary axis. A second counterpulley 6 for biasing the wire into engagement with detector pulley 5 is also rotatably mounted on balance beam 4. As particularly shown in FIG. 3, balance beam 4 is formed with an elongate hole 7 for mounting it on a pin 8 secured to housing 31, so as to be vertically adjustable and at the same time pivotable about pin 8. Adjacent one end balance beam 4 is secured to housing 31 by a hinged link 9. As illustrated, the link maintains horizontal positioning of the balance beam. Disposed below balance beam 4 is a pressure cylinder 10 having a plunger 11 to act as a biasing means for exerting a thrust force on the bottom side of balance beam 4. Pressure cylinder 10 is adjustable longitudinally along balance beam 4 in the direction of arrow 12 to thereby permit the acting position 60 of plunger 11 to be displaced along balance beam 4. The wire 13 to be sprayed, which is only shown in FIGS. 2 and 3, is introduced through an opening 14 formed in the rear wall of housing 31 and retaining therein an eccentrally adjustable wire guide 15 for adaptation to wires of varying thickness. The wire is then introduced into a gas burner head 16 disposed on the front face of the housing and provided with inlet ports 17 for the supply of different gases to be used as heating and conveying gases for the wire material to be sprayed. Gas burner head 16 is mounted on a gas head support 18 which is guided by two elongate holes 19 and adjustable in the vertical direction with the aid of a spindle 20. The adjustment of the gas burner head serves for adapting it to variations of the position of the longitudinal axis of the wire in the case of wires of varying thickness.

As apparent from FIG. 3, counterpulleys 3 and 6 can be adapted to wires 13 of different diameters by the vertical adjustment of balance beam 4. Additionally shown in FIG. 3 are two transmission gears 21 and 22 mounted in coaxial aligmment with feed pulley 2 and counterpulley 3, respectively and fixedly connected to the respective pulleys. These transmission gears are provided for uniformly rotating counterpulley 3. Similar transmission gears may be provided for detector pulley 5 and its counterpulley 6, although these pulleys are not specifically illustrated in FIG. 3.

Diagrammatically shown in FIG. 2 is the control and regulating system for the feed rate of wire 13. To this purpose motor 1 is provided with a tachometer 23 coupled thereto for transmitting an information relating to the rotary speed of the motor to a microprocessor 25 through a line 24 and to an control circuit 27 through a line 26.

Operatively connected to detector pulley 5 is an incremental rotation speed sensor 28 operable by the longitudinal wire feed operation to transmit respective digital signals to microprocessor 25. Finally there is provided a pressure control device 29 cooperating with microprocessor 25 and connected to pressure cylinder 10 through a line 33.

The apparatus operates as follows:

A wire to be sprayed is inserted through opening 14 in the rear wall of housing 31, passed between detector pulley 5 and its associated counterpulley 6, between feed pulley 2 and its associated counterpulley 3, and finally introduced into the front-mounted gas burner head 16. Thanks to the fact that balance beam 4 is adjustable in the vertical direction while feed pulley 2 and detector pulley 5 are rotatable about stationary axes, it is possible to process wires of different diameters without requiring the feed pulley and the detector pulley to be exchanged in accordance with the thickness of the wire. In view of the fact, however, that in an arrangement of the type described the position of the longitudinal center axis of the wire changes in accordance with the thickness of the wire, the wire guide 15 is adjusted and spindle 20-is operated to adjust gas burner head 16 for adaptation to the position of the longitudinal center axis of the wire. After the wire has been inserted, a selected pressure is supplied to pressure cylinder 10, whereby balance beam 4 is raised and counterpulleys 3 and 6 are forced into contact with the bottom side of the wire so as to bias it into engagement with the feed pulley and detector pulley, respectively. The forces exerted on the wire by counterpulley 3 and counterpulley 6 can be differentially selected by displacing pressure cylinder 10 in the direction of arrow 12, whereby the point of attack of plunger 11 of the pressure cylinder is displaced along the balance beam.

The hitherto practiced control of t feed rate of wire 13 was for instance based on the principle that a predetermined feed rate corresponded to any given rotary speed of the motor, based on the known circumferential length of the feed pulley 2 connected to the output shaft of the motor. The feed rate of the wire 13 was thus determined by controlling the rotary speed of motor 1. It has been found, however, that there is frequently some slippage between the feed pulley 2 and the wire, which is not detected by the apparatus itself when the feed rate of the wire is controlled in the manner described above. In these cases the wire is thus supplied to the gas head at irregular feed rates. This results in a faulty coating of the surfaces to be coated.

The origin of such faults is now eliminated by the provision that the actual feed rate of the wire 13 is directly detected with the aid of the detector pulley 5 and the incremental rotation sensor 28 Connected to the detector pulley. The signals generated by the incremental rotation sensor 28 are applied to the microprocessor as an actual-value signal indicative of the wire feed rate. The control operation is then accomplished by storing in the microprocessor a rated value indicative of a predetermined wire feed rate. The rotary speed of the motor 1 is then controlled by control circuit 27 in response to the difference between the stored rated value and the actual value of the wire feed speed detected by detector pulley 5 and supplied to microprocessor 25. If it is then found that regardless of an existing error signal, i.e. a difference between the stored rated value and the actual value of the feed rate resulting in an increase of the rotary speed of motor 1, there occurs no increase, and thus no corresponding correction of the wire feed rate, it is to be concluded that the existing irregularities can no longer be corrected by controlling the rotary speed of motor 1. From experience it is known that irregularities of this kind are usually a lagging of wire speed caused by slippage of the feed pulley 2. According to the invention, therefore, when an irregular condition of this kind has been established, microprocessor 25 is caused to supply a control signal to pressure control device 29, which thereupon operates as a pressure means to increase the pressure in pressure cylinder 10 via line 33. In this manner an increased pressure is exerted on counterpulleys 3 and 6 through balance beam 4. Provided that the malfunction had been caused by slippage of feed pulley 2 and has been reduced by the adjustment of the biasing force of counterpulley 3, the further control of the feed rate may then be accomplished in the conventional manner by controlling the rotational speed of feed motor 1.

A flow chart of a possible embodiment of a control operation of the type described is illustrated in FIG. 4. In this flow chart, $a_N$ designates the difference between the stored rated value and the detected actual value of the wire feed rate. At 40 the rated value of the feed rate of the wire is stored and continuously compared to the detected actual value. If the comparison at 41 shows that $a_N=0$, there will be no further control function. If this is not the case, it is determined at 41 whether $a_N<0$. If this is the case, a corresponding control function is initiated as at 43 for reducing the rotary speed of the feed motor. If, however, neither $a_N=0$ nor $a_N<0$ applies, then it has to be $a_N>0$, in which case the rotary speed of the motor is increased as at 44. If in a subsequent monitoring step 45 it is found that the difference of successive error signals $a_N$, $a_{N-1}$ decreases, it is concluded that the initiated control function is effective whereupon $a_N$ is monitored in step 46 to thereby determine whether $a_N$ decreases to zero. If this is not the case, the rotary speed of the motor is again increased. If, however, the comparison of successively detected feed rates in step 45 shows that the difference value $a_N$ does not decrease, a corresponding control signal is generated at step 47 to result in the described increase of the engagement pressure of counterpulley 3. If the next monitoring step at 48 shows that the magnitude of successively detected difference values $a_N$ and $a_{N-1}$ is decreasing, it is concluded that slippage had obviously occurred, whereupon $a_N$ is monitored as at 49 to determine whether the difference value $a_N$ decreases to zero, or whether the engagement pressure of counterpulley 3 has to be again increased as at 47.

If a still further increase of the engagement pressure of counterpulley 3 does not result in a decrease of the difference value signal $a_N$, a further control step 50 is initiated to determine again whether the difference signal is already zero. If this is the case there is no need for further control functions. If this is not the case, however, it is again determined at step 51 whether $a_N<0$ is possibly the case. If this is the case, the rotary speed of the motor is reduced as at 43. If this is not the case, however, a still further control signal is generated as at 52 for increasing the rotary speed of the motor. If the subsequent monitoring step 53 shows that the difference signal $a_N$ is decreasing, it is determined as at 54 whether the difference signal is already zero. If on the other hand the monitoring step 53 does not show a decrease of the difference signal $a_N$, it is to be concluded that the malfunction cannot be corrected by the elimination of slippage. This implies that the malfunction is due to other, not readily recognizable causes, in response to which the wire feed operation is automatically stopped entirely as at 55.

In order to permit not readily recognizable irregularities to be approximately defined, step 55 additionally includes the function of monitoring the current input to feed motor 1 (FIG. 1), which permits certain conclusions regarding the mechanical environment (wire guides, wire reel etc.) to be drawn therefrom. This monitoring function is continually effective and can be made use of for other defined malfunction detections.

The control functions permitted at steps 43, 44 and 47 are subject to narrow limit values determined by the wire diameter and the wire feeding rate. When these limit values are exceeded, the wire feeding operation is stopped and the defined malfunction is indicated.

We claim:

1. A wire flame spray apparatus comprising a motor, a wire feed pulley driven by the motor, a first counterpulley disposed to bias a wire into engagement with the feed pulley with a biasing force for the feed pulley to feed the wire, detector means for detecting actual wire feed rate, processor means for generating an error signal representative of the difference between the actual wire feed rate and a predetermined wire feed rate, motor control means responsive to the error signal for controlling motor speed to drive the wire feed pulley so as to drive the wire at the predetermined wire feed rate, and pressure means responsive to the error signal for increasing the biasing force in response to a lagging of actual feed rate from the predetermined feed rate so as to reduce slippage of the wire on the feed pulley.

2. The apparatus of claim 1 wherein the detector means comprises a detector pulley disposed to engage the wire so as to detect the actual wire feed rate.

3. The apparatus of claim 2 further comprising a second counterpulley disposed to bias the wire into engagement with the detector pulley.

4. The apparatus of claim 3 further comprising a balance beam with the first and second counterpulleys mounted thereon, and biasing means for acting on an acting position on the balance beam intermediate the counterpulleys so as to bias the first and second counterpulleys into engagement with the wire.

5. The apparatus of claim 4 wherein the acting position on the balance beam is adjustable longitudinally with respect to the balance beam.

6. The apparatus of claim 5 further comprising a housing with the motor, the feed pulley, the detector pulley and the balance beam mounted thereon, and a hinged link connecting between the balance beam and the housing so as to maintain longitudinal positioning of the balance beam.

7. The apparatus of claim 4 wherein the biasing means comprises a pressure cylinder.

8. The apparatus of claim 7 wherein the pressure means comprises a pressure controller for increasing pressure applied to the pressure cylinder.

9. The apparatus of claim 2 further comprising an incremental rotation sensor disposed to sense lagging in rotational speed of the detector pulley and generate corresponding signals, the pressure means being responsive to the corresponding signals so as to increase the biasing force.

10. The apparatus of claim 9 further comprising a control circuit for supplying the motor with an operating voltage, a tachometer disposed to measure rotational speed of the motor, and a microprocessor system connected responsively to the incremental rotation sensor, the tachometer and the pressure means, the microprocessor system being further connected to provide control signals to the pressure means and to the control circuit.

11. The apparatus of claim 1 further comprising transmission means for transmitting feed pulley rotation to the counterpulley.

12. The apparatus of claim 11 wherein the transmission means comprises engaged gears concentrically connected respectively to the feed pulley and the counterpulley.

* * * * *